US007762202B2

(12) United States Patent
Kishi et al.

(10) Patent No.: US 7,762,202 B2
(45) Date of Patent: Jul. 27, 2010

(54) EMBROIDERY SEWING SYSTEM

(75) Inventors: Motoshi Kishi, Nagoya (JP); Shoichi Taguchi, Nagoya (JP); Yoshio Sugiura, Aichi-ken (JP); Masayuki Iwata, Gifu (JP); Hiroyuki Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 132 days.

(21) Appl. No.: 12/073,261

(22) Filed: Mar. 3, 2008

(65) Prior Publication Data

US 2008/0223275 A1 Sep. 18, 2008

(30) Foreign Application Priority Data

Mar. 13, 2007 (JP) ..... 2007-062917

(51) Int. Cl.
*D05B 21/00* (2006.01)

(52) U.S. Cl. ..... 112/102.5

(58) Field of Classification Search ..... 112/102.5, 112/84, 103; 700/135, 137, 138
See application file for complete search history.

(56) References Cited

U.S. PATENT DOCUMENTS 5,313,902 A * 5/1994 Shoji ..... 112/454
5,355,319 A * 10/1994 Matsubara ..... 700/137
6,629,015 B2 9/2003 Yamada
7,212,879 B2 5/2007 Hagino
7,228,195 B2 * 6/2007 Hagino ..... 700/138

FOREIGN PATENT DOCUMENTS

| | | |
|---|---|---|
| CN | 1624229 A | 6/2005 |
| JP | A-2000-132102 | 5/2000 |
| JP | A-2001-259268 | 9/2001 |
| JP | A-2002-352201 | 12/2002 |
| JP | A-2005-056362 | 3/2005 |
| JP | A-2005-084954 | 3/2005 |
| JP | A-2005-146499 | 6/2005 |
| JP | A-2005-160936 | 6/2005 |
| JP | A-2005-165951 | 6/2005 |
| JP | A-2005-226165 | 8/2005 |
| JP | A-2006-087576 | 4/2006 |

* cited by examiner

*Primary Examiner*—Tejash Patel
(74) *Attorney, Agent, or Firm*—Oliff & Berridge, PLC

(57) ABSTRACT

An embroidery sewing system includes an embroidery data processing apparatus and a sewing apparatus. The embroidery data processing apparatus generates and processes embroidery data used to sew an embroidery pattern on a work cloth. The embroidery data processing apparatus includes an embroidery data generation device that generates embroidery data including pattern data for specifying a color and a shape of the embroidery pattern, and a data writing device that writes the embroidery data into an RFID tag attached to the work cloth. The sewing apparatus includes a sewing device that sews the embroidery pattern based on the embroidery data, a data reading device that reads out the embroidery data written into the RFID tag by the data writing device, and a control device that controls the sewing device based on the embroidery data read out from the RFID tag.

7 Claims, 17 Drawing Sheets

FIG. 10

| SEWING INFORMATION | DATA |
|---|---|
| COLOR CHANGE A | PINK |
| SEWING DATA | Xa0, Ya0 |
| SEWING DATA | Xa1, Ya1 |
| SEWING DATA | Xa2, Ya2 |
| ⋮ | ⋮ |
| ⋮ | ⋮ |
| SEWING DATA | XaN, YaN |
| COLOR CHANGE B | DEEP PINK |
| SEWING DATA | Xb0, Yb0 |
| SEWING DATA | Xb1, Yb1 |
| SEWING DATA | Xb2, Yb2 |
| ⋮ | ⋮ |
| ⋮ | ⋮ |
| ⋮ | ⋮ |
| SEWING DATA | XbN, YbN |
| COLOR CHANGE C | YELLOW GREEN |
| SEWING DATA | Xc0, Yc0 |
| SEWING DATA | Xc1, Yc1 |
| SEWING DATA | Xc2, Yc2 |
| ⋮ | ⋮ |
| ⋮ | ⋮ |
| SEWING DATA | XcN, YcN |
| COLOR CHANGE D | GREEN |
| SEWING DATA | Xd0, Yd0 |
| SEWING DATA | Xd1, Yd1 |
| SEWING DATA | Xd2, Yd2 |
| ⋮ | ⋮ |
| ⋮ | ⋮ |
| SEWING DATA | XdN, YdN |

FIG. 11

| EDIT INFORMATION | DATA |
|---|---|
| HORIZONTAL MIRROR | 1 |
| VERTICAL MIRROR | 0 |
| MOVEMENT X | 20 |
| MOVEMENT Y | 40 |
| ROTATION | 0 |
| SCALE UP/DOWN X | 0 |
| SCALE UP/DOWN Y | 0 |
| SPACING | 0(STANDARD) |
| ARRAY | 0(STANDARD) |
| DENSITY | 0(STANDARD) |
| COLOR CHANGE A | 0 |
| COLOR CHANGE B | RGB |
| COLOR CHANGE C | 0 |
| COLOR CHANGE D | 0 |
| ⋮ | ⋮ |
| COLOR CHANGE N | 0 |

FIG. 15

| STITCH COUNT INFORMATION | DATA |
|---|---|
| NUMBER OF STITCHES | 0 |

EMBROIDERY SEWING SYSTEM

CROSS-REFERENCE TO RELATED APPLICATION

This application claims priority to Japanese Patent Application No. 2007-062917, filed Mar. 13, 2007, the disclosure of which is hereby incorporated herein by reference in its entirety.

BACKGROUND

The present disclosure relates to an embroidery sewing system. More specifically, it relates to an embroidery sewing system including a sewing apparatus that can perform embroidery sewing and an embroidery data processing apparatus that can generate and process embroidery data to be used by the sewing apparatus in embroidery sewing.

A conventional sewing machine is capable of sewing an embroidery pattern including a character, a symbol, a design, etc. on a work cloth as a sewing target. To sew an embroidery pattern by the conventional sewing machine, it is necessary to generate embroidery data to be used for embroidery sewing by the sewing machine. In such a case, the embroidery data can be generated by an embroidery data generation apparatus that is built in or that is provided separate from the sewing machine. When the embroidery data is generated, a user first selects an embroidery pattern to be sewn, and edits the selected pattern into a desired adjusted pattern by, for example, appropriately flipping the pattern, changing its size and color, and moving its position. The user can also set an appropriate sewing speed and tension of the upper thread for the sewing machine. After the embroidery pattern is selected and embroidery conditions are set by the user in such a manner, the embroidery data is automatically generated by the embroidery data generation apparatus.

Radio Frequency Identification (RFID) technology is commonly known, and involves an IC chip equipped with an antenna is employed. The IC chip with the antenna may be referred to as an "RFID tag", and shaped like a tag, a label, or the like. The RFID tag may be added to a variety of products so that information stored in the RFID tag may be read out from the RFID tag or information may be written into the RFID tag, with an apparatus referred to as an "RFID reader/writer". The RFID technology is utilized in various fields in order to identify or control individuals' actions. For example, Japanese Patent Application Laid Open Publication No. 2005-160936 discloses an RFID tag that is attached to a work cloth as a sewing target and that stores information to identify the type of work cloth. It is also disclosed that a control device of an eyelet buttonholing sewing machine determines whether a pressing pressure and a tension set for the sewing machine are suitable for the type of the work cloth indicated by the identification information of the work cloth read out by an RFID reader/writer of the sewing machine.

In the aforementioned technology, the RFID tag attached to the work cloth stores the identification information concerning only the type of work cloth. Therefore, although the type of the work cloth can be identified and corresponding setting of certain conditions can be automatically carried out, the user still needs to set other detailed conditions on a case-by-case basis. As described above, in the case of sewing an embroidery pattern, in order to obtain a desired embroidery result, the user may need to make various edits to the embroidery pattern and set various embroidery conditions in a process of generating embroidery data. Therefore, if the user is not familiar with a sewing machine, problems may occur because these jobs are troublesome and time-consuming.

SUMMARY

Various exemplary embodiments of the broad principles herein provide an embroidery sewing system that enables a user of a sewing apparatus to easily sew a desired embroidery pattern on a work cloth as a sewing target without a need to perform troublesome editing of the embroidery pattern or setting of embroidery conditions.

The exemplary embodiments provide an embroidery sewing system including an embroidery data processing apparatus that generates and processes embroidery data to sew an embroidery pattern on a work cloth as a sewing target, and a sewing apparatus. The embroidery data processing apparatus includes an embroidery data generation device that generates embroidery data including pattern data for specifying a color and a shape of the embroidery pattern, and a data writing device that writes the embroidery data generated by the embroidery data generation device into an RFID tag attached to the work cloth. The sewing apparatus includes a sewing device that sews the embroidery pattern based on the embroidery data generated and processed by the embroidery data processing apparatus, a data reading device that reads out the embroidery data written into the RFID tag by the data writing device, and a control device that controls the sewing device based on the embroidery data read out from the RFID tag by the data reading device.

BRIEF DESCRIPTION OF THE DRAWINGS

Exemplary embodiments of the disclosure will be described below in detail with reference to the accompanying drawings in which:

FIG. 10 is an explanatory table of pattern data.

FIG. 11 is an explanatory table of edit data.

FIG. 15 is an explanatory table of stitch count data.

DETAILED DESCRIPTION

The following describes embodiments of an embroidery sewing system according to the present disclosure, with reference to the drawings. The configuration of apparatuses and flowcharts of various processing are not intended to limit the scope of the invention but are just examples for explanation.

Figure 1:
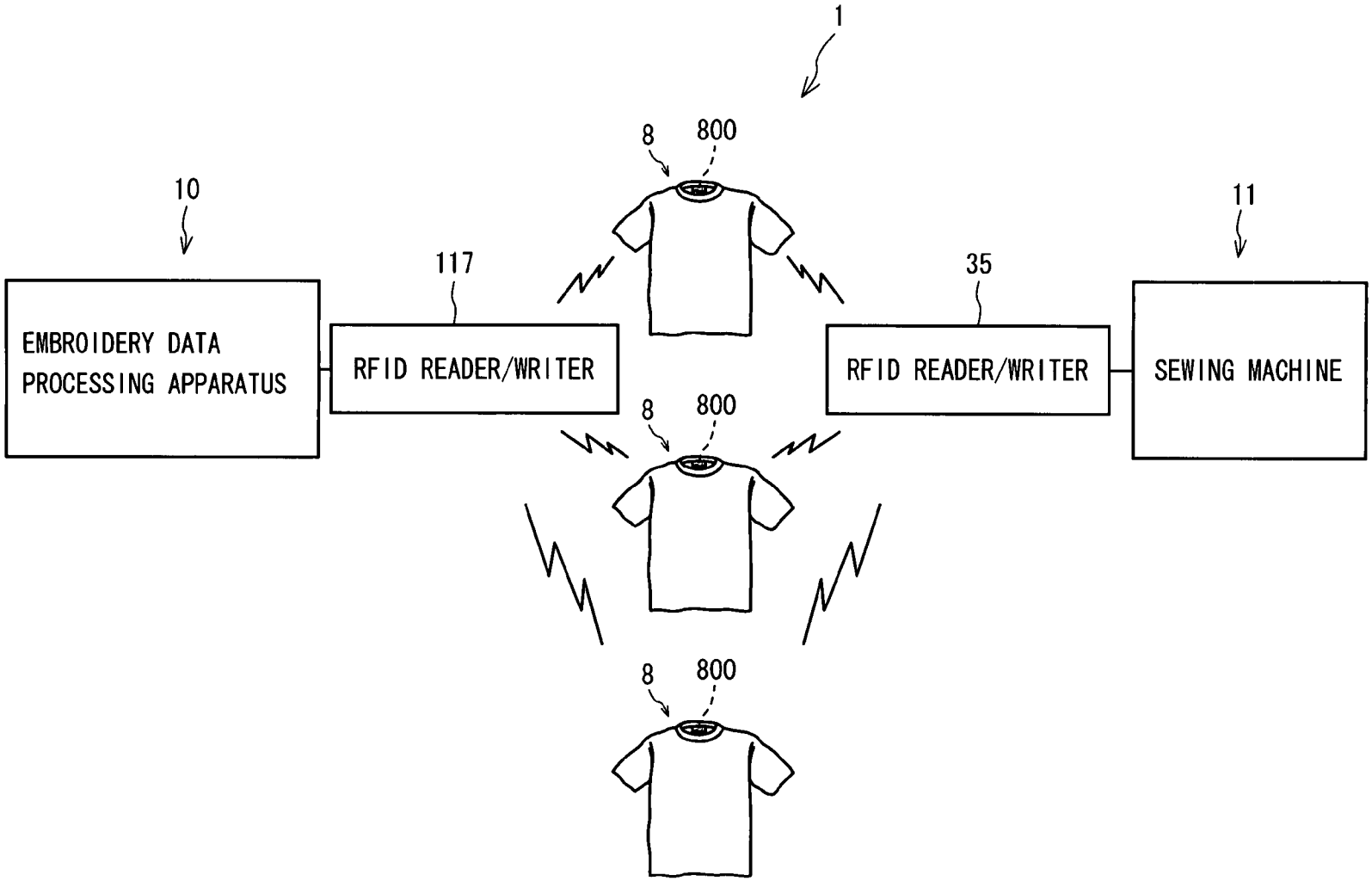
FIG. 1 is a system configuration diagram of an embroidery sewing system.

First, the general configuration of an embroidery sewing system 1 in the present embodiment is described below with reference to FIG. 1. As shown in FIG. 1, the embroidery sewing system 1 includes an embroidery data processing apparatus 10 and a sewing machine 11. The embroidery data processing apparatus 10 can generate and edit embroidery data, which is used by the sewing machine 11 to sew a desired embroidery pattern. The embroidery data processing apparatus 10 includes an RFID reader/writer 117, with which wireless communication with an RFID tag 800 can be established to transmit or receive data. Moreover, the sewing machine 11 is a multi-needle type sewing machine, which is capable of embroidery sewing. The sewing machine 11 also has an RFID reader/writer 35 similar to that of the embroidery data processing apparatus 10, and with the RFID reader/writer 35, wireless communication with the RFID tag 800 can be established to transmit or receive data. In the embroidery sewing system 1, embroidery data of a desired embroidery pattern is first generated in the embroidery data processing apparatus 10 and then written into the RFID tag 800 attached to a garment (e.g., a T-shirt) 8 on which the embroidery pattern is to be sewn. Subsequently, the garment 8 is sent to the sewing machine 11 for embroidery sewing. The sewing machine 11 can read out the embroidery data from the RFID tag 800 attached to the garment 8 with the RFID reader/writer 35, and sew the desired embroidery pattern on the garment 8 in accordance with the read embroidery data.

Figure 2:
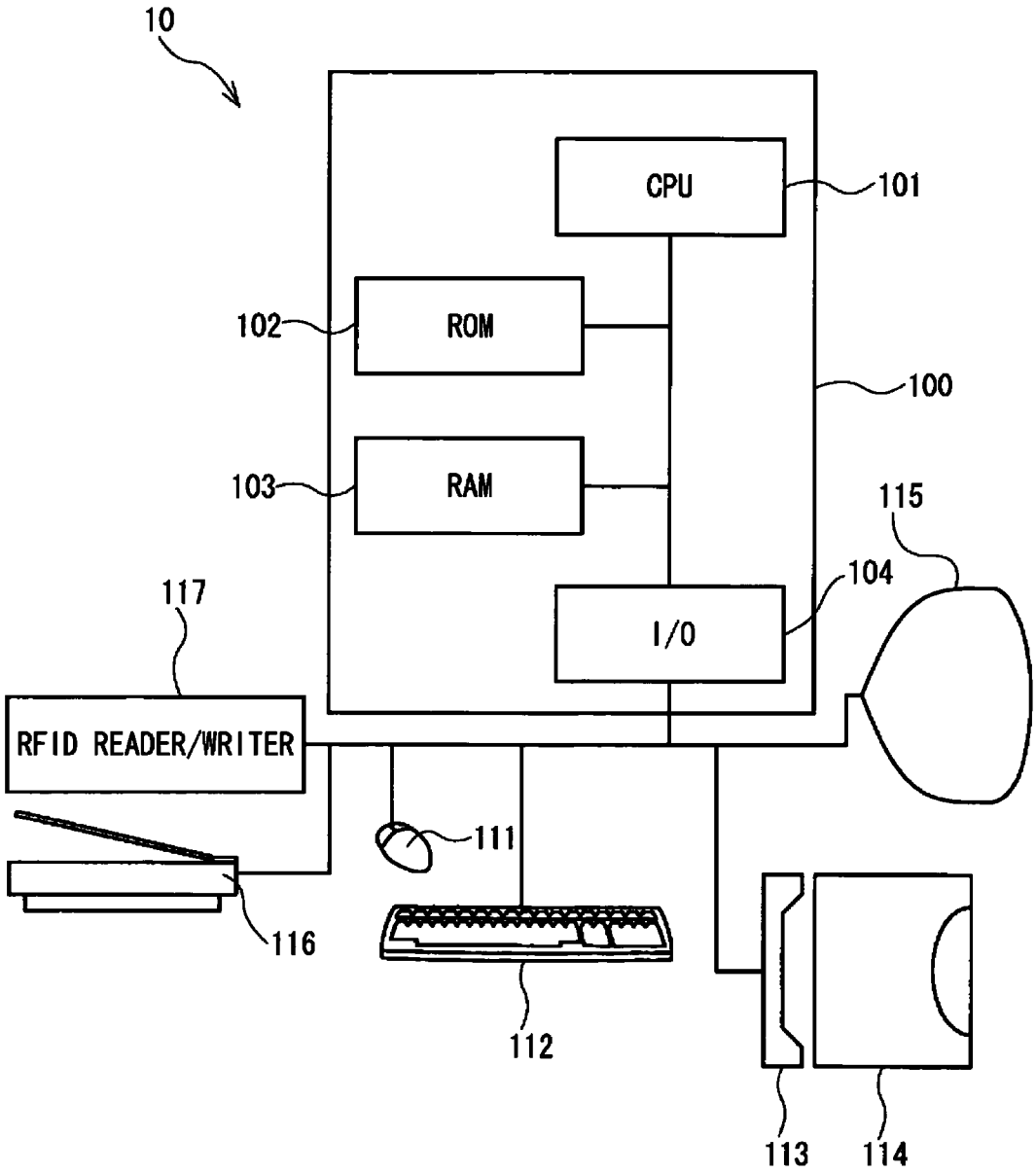
FIG. 2 is a block diagram showing an electrical configuration of an embroidery data processing apparatus.

Next, the configuration of the embroidery data processing apparatus 10 is described below with reference to FIG. 2. As shown in FIG. 2, the embroidery data processing apparatus 10 includes an apparatus body 100, which is a dedicated machine, and a mouse 111, a keyboard 112, a memory card connector 113, a display device 115, an image scanner 116, and an RFID reader/writer 117 which are connected to the apparatus body 100. As shown in FIG. 2, the apparatus body 100 includes a CPU 101, a ROM 102, a RAM 103, and an I/O interface 104, which are connected to each other via a bus. The mouse 111, the keyboard 112, the memory card connector 113, the display device 115, the image scanner 116, and the RFID reader/writer 117 are connected to the I/O interface 104. To the memory card connector 113, a memory card 114 can be connected. Therefore, the data stored in the embroidery data processing apparatus 10 can be written into the memory card 114 and outputted.

The CPU 101 performs various kinds of computations and processing according to a variety of programs stored in the ROM 102, which is a read only memory. In a case where the apparatus body 100 is a dedicated one as in the present embodiment, an embroidery data generation program, which is described later, is stored in the ROM 102 beforehand. On the other hand, if the apparatus body 100 is a general purpose one (a personal computer etc.), the embroidery data generation program stored on a hard disk and the like may be read into the RAM 103 and executed.

The RFID reader/writer 117 may be any known RFID reader/writer that can communicate with the RFID tag 800 (see FIG. 3) through radio waves to read and write information. In the present embodiment, the RFID tag 800 is attached to the garment 8. Although not illustrated, the configuration of the RFID reader/writer 117 is described below. The RFID reader/writer 117 has an antenna, a transmission/reception circuit, a signal processing circuit, and a control circuit. The antenna of the RFID reader/writer 117 transmits and receives a signal through wireless communication with an antenna 811 of the RFID tag 800. The transmission/reception circuit is used to access an IC circuit section 820 of the RFID tag 800 via the antenna, to read or write information. The signal processing circuit processes a signal read out from the RFID tag 800. The control circuit may be, for example, a microcomputer and include a CPU, a ROM, a RAM, etc. The control circuit performs signal processing in accordance with a program stored beforehand in the ROM, utilizing temporary storage areas of the RAM.

Figure 3:
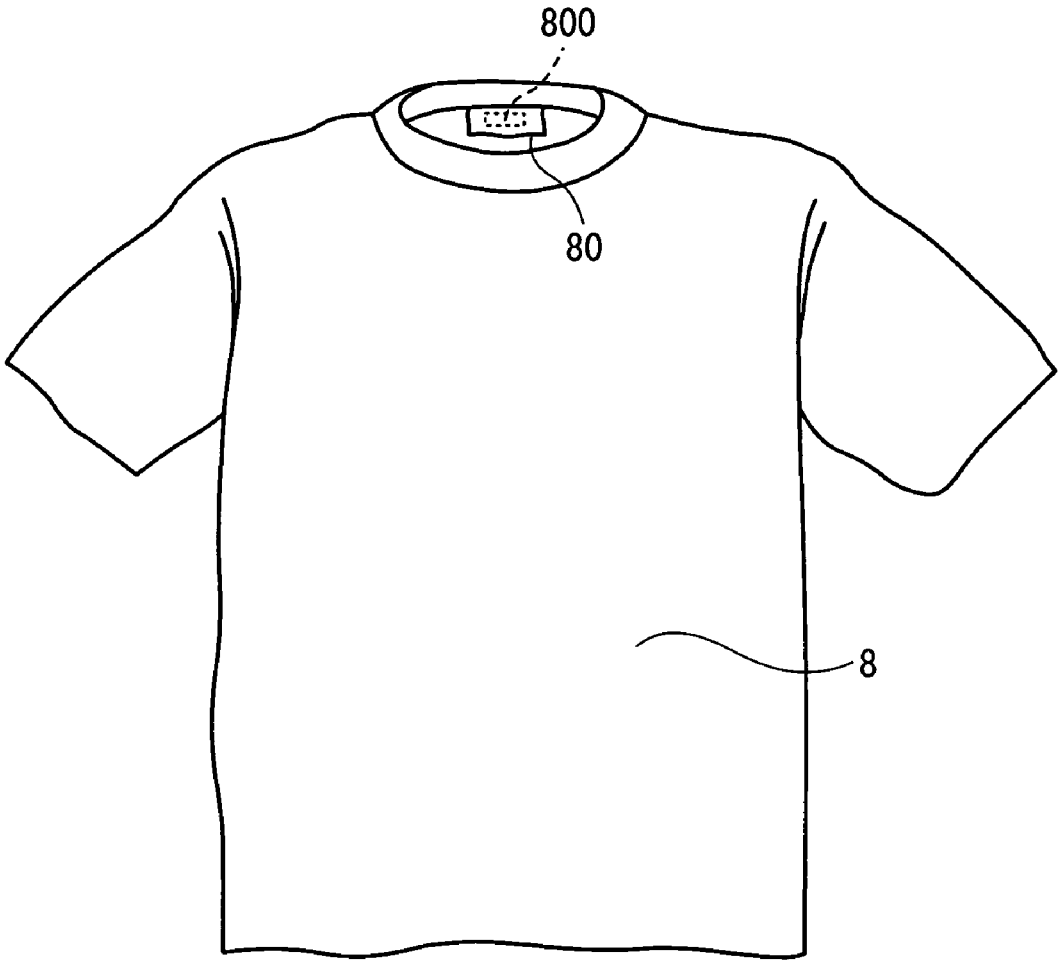
FIG. 3 is a schematic illustration of a garment to which an RFIDRFID tag is attached.
Figure 4:
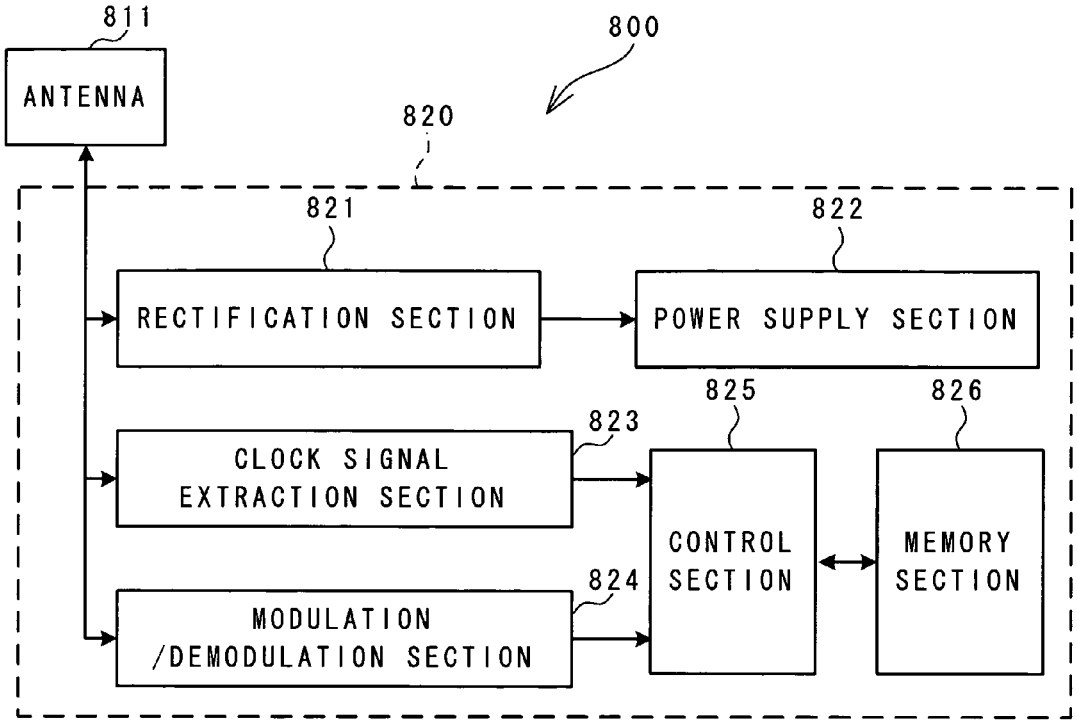
FIG. 4 is a block diagram showing an electrical configuration of the RFID tag.
Figure 5:
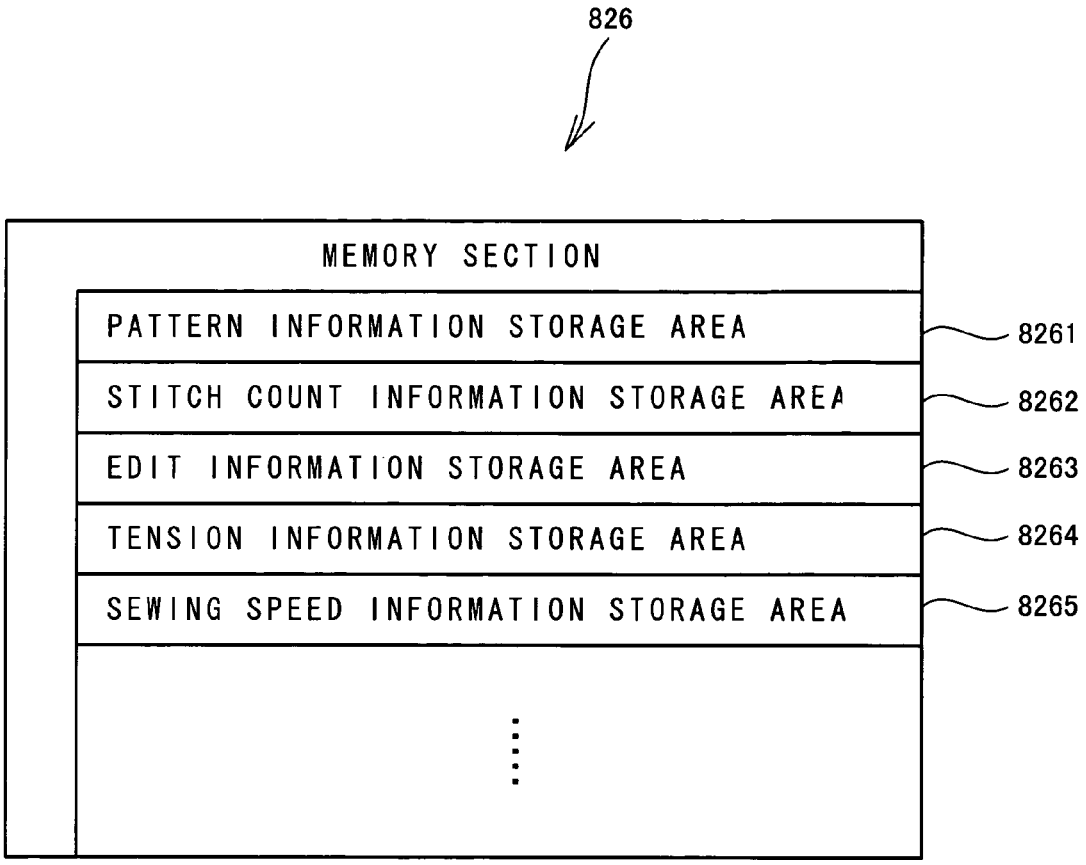
FIG. 5 is an explanatory diagram of storage areas of a memory section of the RFID tag.

Next, the RFID tag 800 attached to the garment 8, which is a target of embroidery sewing, is described below with reference to FIGS. 3-5. As shown in FIG. 3, a label 80 that shows product information, such as a material of the garment 8, is sewn on the neck of a back body of the garment 8 (e.g., T-shirt). The label 80 is formed by sewing up two pieces of a fabric sandwiching a sheet-like RFID tag 800. The physical configuration of the sheet-like RFID tag 800 is not described here, because it is commonly known. The electrical configuration of the RFID tag 800 is as shown in FIG. 4. The RFID tag 800 includes the antenna 811 and the IC circuit section 820. The antenna 811 can transmit or receive signals without contact through radio waves to or from the antenna (not shown) of the RFID reader/writer 117 of the embroidery data processing apparatus 10 or the RFID reader/writer 35 of the sewing machine 11. The IC circuit section 820 includes a rectification section 821 connected to the antenna, a power supply section 822 connected to the rectification section 821, a clock signal extraction section 823 connected to the antenna, a modulation/demodulation section 824 connected to the antenna, a control section 825 connected to the clock signal extraction section 823 and the modulation/demodulation section 824, and a memory section 826 connected to the control section 825. The rectification section 821 rectifies a carrier wave received via the antenna 811. The power supply section 822 accumulates the energy of the carrier waves rectified by the rectification section 821 and utilizes the energy as driving power. The clock signal extraction section 823 extracts a clock signal from the carrier wave received by the antenna 811, and supplies the extracted signal to the control section 825. The modulation/demodulation section 824 demodulates a signal transmitted on a carrier wave from the RFID reader/writer 117 or 35 and received via the antenna 811, and modulates and reflects the received carrier wave based on a response signal from the control section 825. The control section 825 controls the basic operations of the RFID tag 800. The control section 825, for example, interprets a received signal demodulated by the modulation/demodulation section 824 and generates a response signal based on information stored in the memory section 826, and sends it back via the modulation/demodulation section 824.

The memory section 826 is described below in detail with reference to FIG. 5. The memory section 826 has a plurality of storage areas including a pattern information storage area 8261, a stitch count information storage area 8262, an edit information storage area 8263, a tension information storage area 8264, and a sewing speed information storage area 8265. The pattern information storage area 8261 stores data of needle drop points and colors of sewing threads for an embroidery pattern to be sewn, in the order of sewing sequence. The stitch count information storage area 8262 stores data of a number of stitches that have already been formed for the embroidery pattern. The edit information storage area 8263 stores edit data relating to, for example, a flip, a movement, a rotation, a scale-up/down, and a change in sewing thread color of the embroidery pattern to be sewn. The tension information storage area 8264 stores data of a tension of the upper thread that has been set. The sewing speed information storage area 8265 stores data of a sewing speed that has been set.

Figure 6:
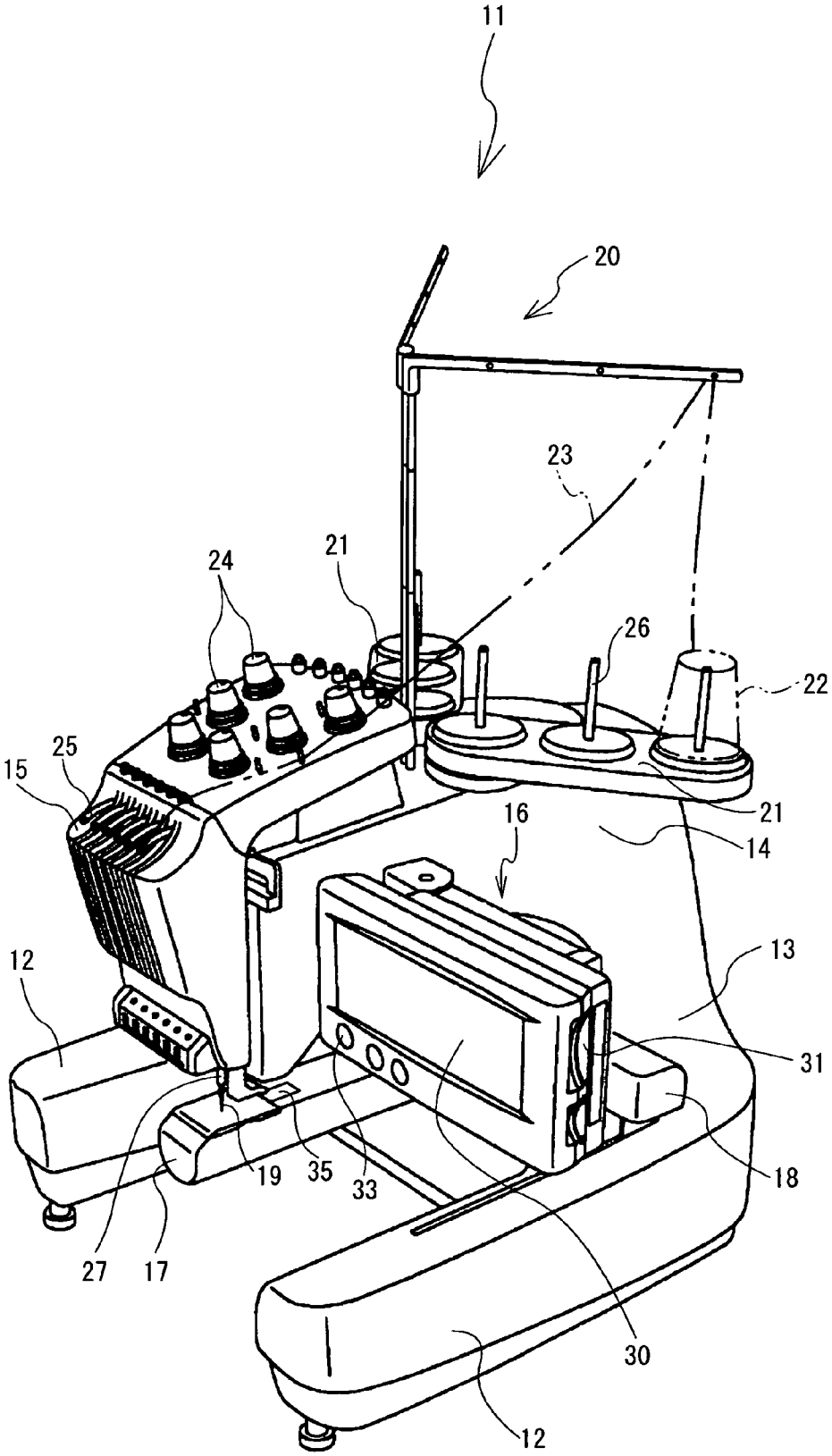
FIG. 6 is a perspective view of a sewing machine.

Next, the configuration of the sewing machine 11 is described below with reference to FIGS. 6-8. In FIG. 6, the left near side of the paper is referred to as the "front side of the sewing machine 1" and the right far side of the paper is referred to as the "rear side of the sewing machine 1". The right and left directions of the paper as viewed from an operator of the sewing machine 11 is referred to as the "right and left directions of the sewing machine 11".

First, the physical configuration of the sewing machine 11 is described below with reference to FIG. 6. As shown in FIG. 6, the sewing machine 11 is a so-called multi-needle type sewing machine, which has a plurality of needle bars. The sewing machine 11 includes support portions 12, a pillar 13, an arm 14, and a needle bar case 15. The support portion 12 supports the entirety of the sewing machine 11. The pillar 13 extends upward from the support portion 12. The arm 14 extends toward the front side of the sewing machine 11 from the upper end of the pillar 13. The needle bar case 15 is attached to an end of the arm 14 in such a manner that it can move in the right-and-left direction. Although only one needle bar 27 is shown in FIG. 6, the needle bar case 15 has six needle bars 27. To each of the needle bars 27, a sewing needle 19 is attached. In sewing an embroidery pattern, the needle bar case 15 is first moved in the right-and-left direction by a switchover mechanism 55 (see FIG. 7) to select one of the six needle bars 27, which is to be moved up and down. Then, a drive shaft 28 (see FIG. 7) is rotationally driven by a sewing machine motor 54 (see FIG. 7). The rotary driving force of the drive shaft 28 is transmitted to a needle bar driving mechanism 29 (see FIG. 7) to move up and down the needle bar 27. As a result, stitches can be formed on a work cloth with the sewing needle 19 attached to the lower end of the needle bar 27 in cooperation with a shuttle 59 (see FIG. 7) disposed in a cylinder bed 17.

Figure 16:
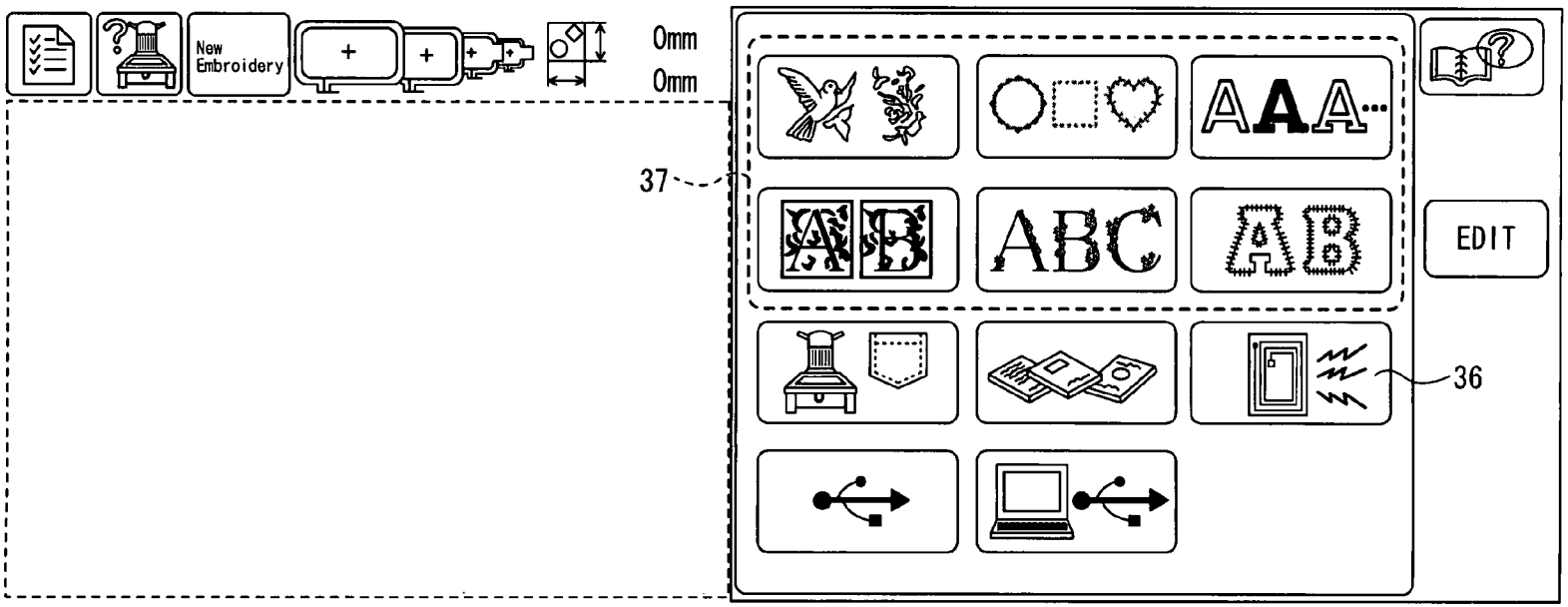
FIG. 16 is a schematic illustration of a pattern selection screen.

Further, an operation portion 16 is axially supported on the right side in the mid-section of the arm 14. The operation portion 16 includes a liquid crystal display (LCD) 30, a flexible disk drive 31 (hereinafter abbreviated as "FDD"), and a start/stop switch 33. A flexible disk can be inserted into the FDD 31. The start/stop switch 33 is used to instruct starting and stopping of sewing. The LCD 30 displays, for example, thread information of the threads set for the needle bars, an embroidery pattern to be sewn, sewing conditions such as tension of the threads and the sewing speed, function names for directing various functions for sewing operations to be performed, and a variety of messages. The LCD 30 has a touch panel 32 (see FIG. 7). When the operator selects with a finger or a dedicated pen any one of various operation keys (see FIG. 16) displayed on the LCD 30, the selected key is sensed by the touch panel 32. In such a manner, the operator can enter a variety of instructions via the LCD 30. The sewing machine 11 stores data of embroidery patterns that can be sewn. The operator can select a desired embroidery pattern and edit the embroidery pattern by selecting a desired edit item on an edit screen displayed on the LCD 30. The edit item may be, for example, a flip, a movement, a rotation, a scale up/down of the pattern, or a change in color of a sewing thread.

Under the arm 14, the cylinder bed 17 extends toward the front side from the lower end of the pillar 13. In the front end portion of the cylinder bed 17, the shuttle 59 and a shuttle driving mechanism 58 (see FIG. 7) are disposed. The shuttle driving mechanism 58 rotationally drives the shuttle 59. A bobbin (not shown), around which a lower thread is wound, can be installed in the shuttle 59. Also under the arm 14, a right-and-left movement mechanism 18 is disposed. The right-and-left movement mechanism 18 is used to move an embroidery frame (not shown) in the right-and-left direction, and driven by an X-axis motor 63 (see FIG. 7). In each of right and left legs of the support portion 12, front-and-rear movement mechanism 68 (see FIG. 7) and a Y-axis motor 64 (see FIG. 7) are disposed. The front-and-rear movement mechanism 68 is used to move the entirety of the right-and-left movement mechanism 18 in the front-and-rear direction, and driven by the Y-axis motor 64 (see FIG. 7). When sewing an embroidery pattern, an embroidery frame, to which a work cloth is attached, can be set to a carriage (not shown) of the right-and-left movement mechanism 18. Then, the embroidery pattern can be sewn while the embroidery frame is moved in the right-and-left direction and the front-and-rear direction by the X-axis motor 63 and the Y-axis motor 64 (see FIG. 7) respectively.

Further, on the upper surface near the rear side of the arm 14, a pair of right and left spool stands 21 is disposed. From each of the spool stands 21, three spool pins 26 protrude. A thread spool 22 can be fitted to each of the spool pins 26. Three thread spools 22 can be placed on each of the spool stands 21. Therefore, six thread spools 22, which number is the same as the number of the sewing needles 19, can be placed in total. An upper thread 23 extending from each of the thread spools 22 placed on the spool stand 21 is supplied to each of the sewing needles 19 via a thread guide mechanism 20, a tensioner 24, and a thread take-up lever 25. The thread guide mechanism 20 prevents the upper thread 23 from tangling. The tensioner 24 is used to adjust a tension of the upper thread 23. The thread take-up lever 25 takes up the upper thread 23 by reciprocating up and down.

Next, the electrical configuration of the sewing machine 11 is described below with reference to FIGS. 7 and 8. As shown in FIG. 7, the sewing machine 11 has a control unit 41 as its core. The control unit 41 includes a CPU 45, a ROM 46, a RAM 47, an EEPROM 48, and an input/output interface (I/O) 50, which are connected to each other via a bus 49. Connected to the I/O 50 are a FDD 31, the start/stop switch 33, the RFID reader/writer 35, a sewing machine drive section 57, an embroidery frame drive section 65, an LCD drive circuit 66 to which the LCD 30 is connected, and the touch panel 32.

The CPU 45 handles main control of the sewing machine 11, and performs various computations and processing in accordance with the various programs stored in the ROM 46, which is a read only memory. For example, a sewing control program, which is described later, is stored in the ROM 46. If the sewing control program is not stored in the ROM 46, a sewing control program stored in a flexible disk etc. may be read into the RAM 103 to be executed.

The RAM 47, which is a random access memory, has storage areas to store various kinds of data temporarily. The RAM 47 is described below in detail with reference to FIG. 8. The RAM 47 has a plurality of storage areas including a pattern information storage area 471, a stitch count information storage area 472, an edit information storage area 473, a tension information storage area 474, and a sewing speed information storage area 475. The pattern information storage area 471 stores data of needle drop points and colors of sewing threads for an embroidery patterns to be sewn, in the order of sewing sequence. The stitch count information storage area 472 stores data of the number of stitches that have already been formed. The edit information storage area 473 stores edit data relating to, for example, a flip, a movement, a rotation, a scale up/down, and a change in color of a sewing thread, of the embroidery pattern to be sewn. The tension information storage area 474 stores data of a tension of the upper thread that has been set. The sewing speed information storage area 475 stores data of a sewing speed that has been set.

Figure 7:
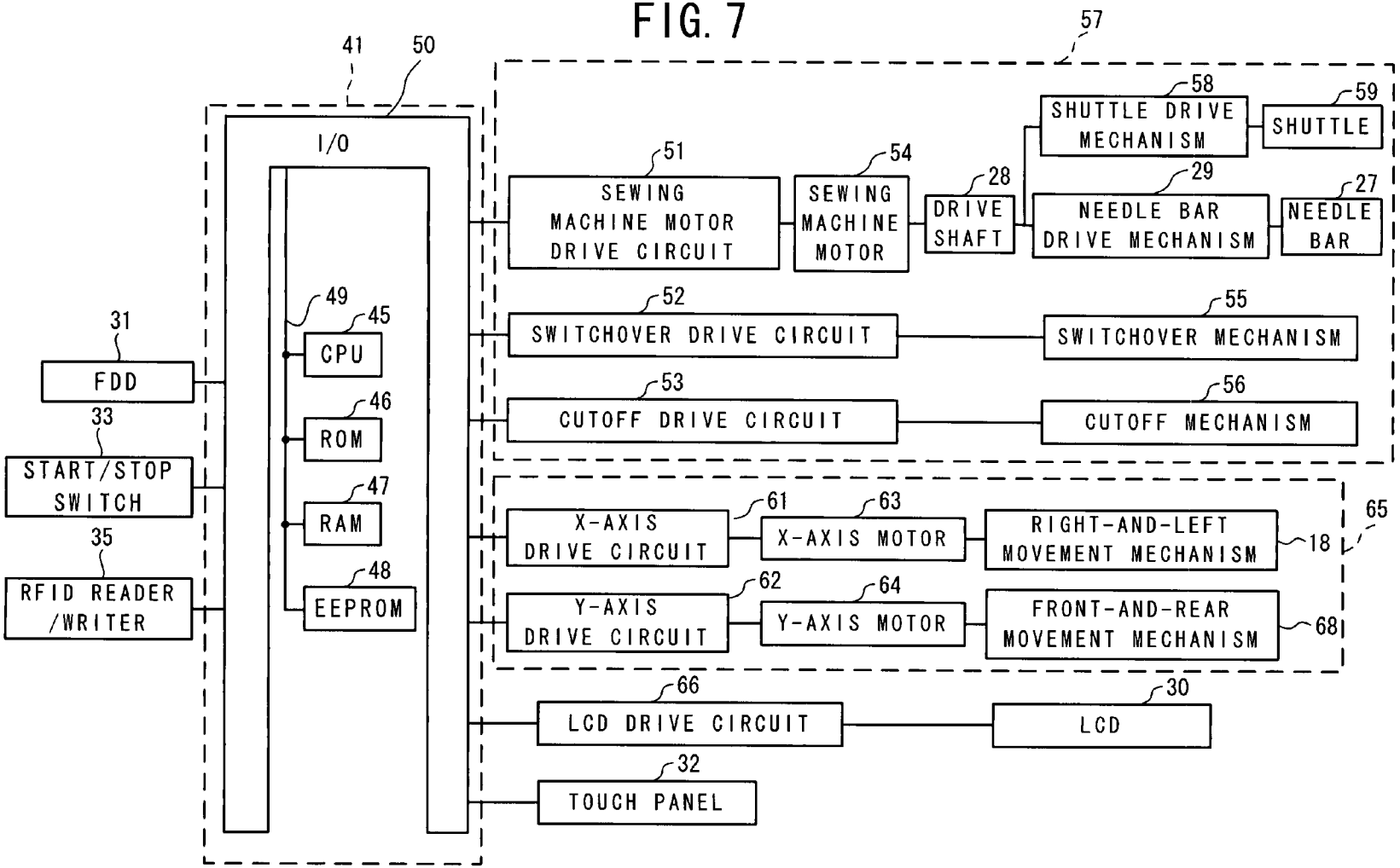
FIG. 7 is a block diagram showing an electrical configuration of the sewing machine.
Figure 8:
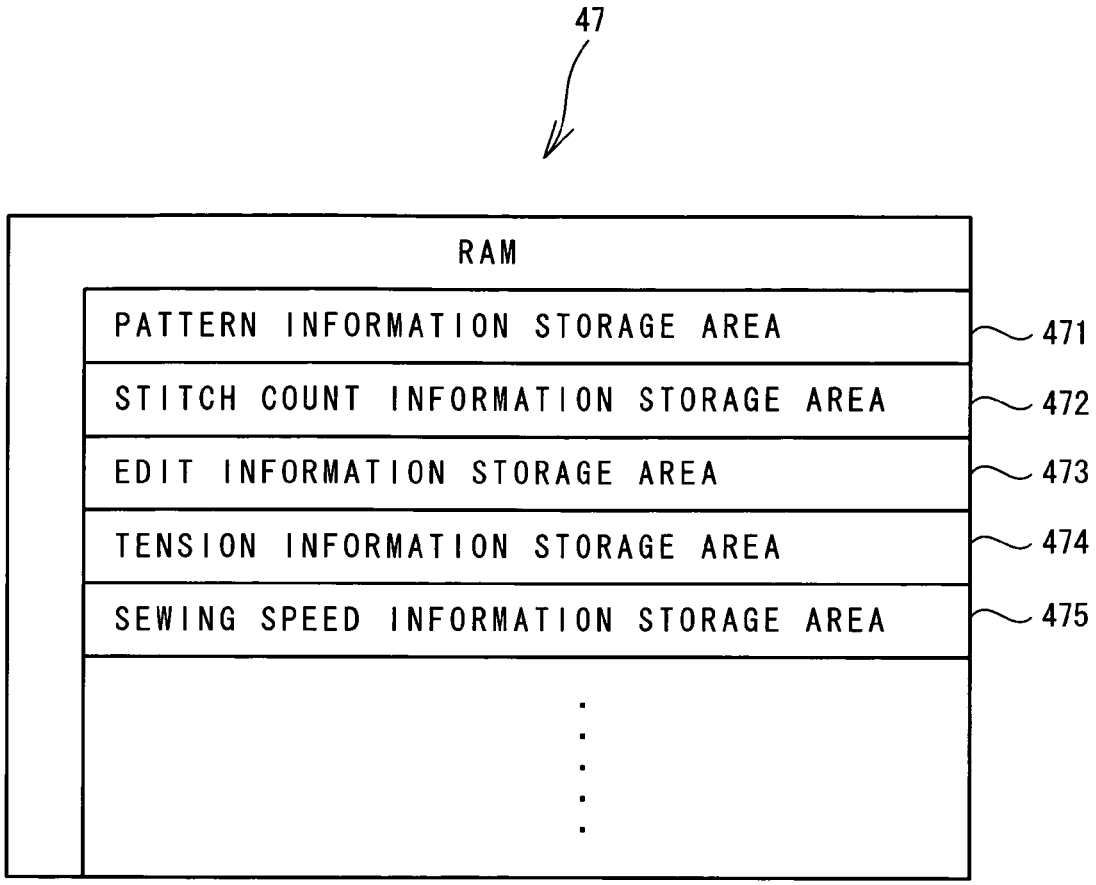
FIG. 8 is an explanatory diagram of storage areas of an RAM in the sewing machine.

The RFID reader/writer 35 shown in FIG. 7 may be any known RFID reader/writer having the same configuration as that of the aforementioned RFID reader/writer 117 of the embroidery data processing apparatus 10. The RFID reader/writer 35 can perform wireless communication with the RFID tag 800 (see FIG. 3) attached to the garment 8, to read and write information without contact.

The sewing machine drive section 57 includes the sewing machine motor 54 and a sewing machine motor drive circuit 51. The sewing machine motor rotates the drive shaft 28, and the sewing machine motor drive circuit 51 drives the sewing machine motor 54 in accordance with a control signal from the control unit 41. The rotation of the drive shaft 28 is transmitted to the shuttle drive mechanism 58, which is configured to rotate the shuttle 59 and to the needle bar drive mechanism 29, which is configured to move up and down the needle bar 27. Further, the sewing machine drive section 57 includes the switchover mechanism 55 and a switchover drive circuit 52. The switchover mechanism 55 selects and changes the needle bars 27 to be moved, and the switchover drive circuit 52 drives the switchover mechanism 55 in accordance with a control signal from the control unit 41. Further, the sewing machine drive section 57 includes a cutoff mechanism 56 and a cutoff drive circuit 53. The cutoff mechanism 56 is configured to cut off the upper thread and/or the lower thread when sewing ends or a jump stitch is formed. The cutoff drive circuit 53 drives the cutoff mechanism 56 in accordance with a control signal from the control unit 41.

The embroidery frame drive section 65 includes the X-axis motor 63 and an X-axis drive circuit 61. The X-axis motor 63 drives the right-and-left movement mechanism 18. The X-axis drive circuit 61 drives the X-axis motor 63 in accordance with a control signal from the control unit 41. The embroidery frame drive section 65 also includes the Y-axis motor 64 and a Y-axis drive circuit 62. The Y-axis motor 64 drives the front-and-rear movement mechanism 68. The Y-axis drive circuit 62 drives the Y-axis motor 64 in accordance with a control signal from the control unit 41.

Next, the flow of processing performed in the embroidery sewing system 1 is described below. The processing to be described herein begins with the generation of embroidery data up to the sewing of an embroidery pattern. First, the processing to generate embroidery data in the embroidery data processing apparatus 10 is described below with reference to FIGS. 9-11. The embroidery data generation program that causes the CPU 101 to perform the processing shown in FIG. 9 is stored in the ROM 102 beforehand (see FIG. 2).

Figure 9:
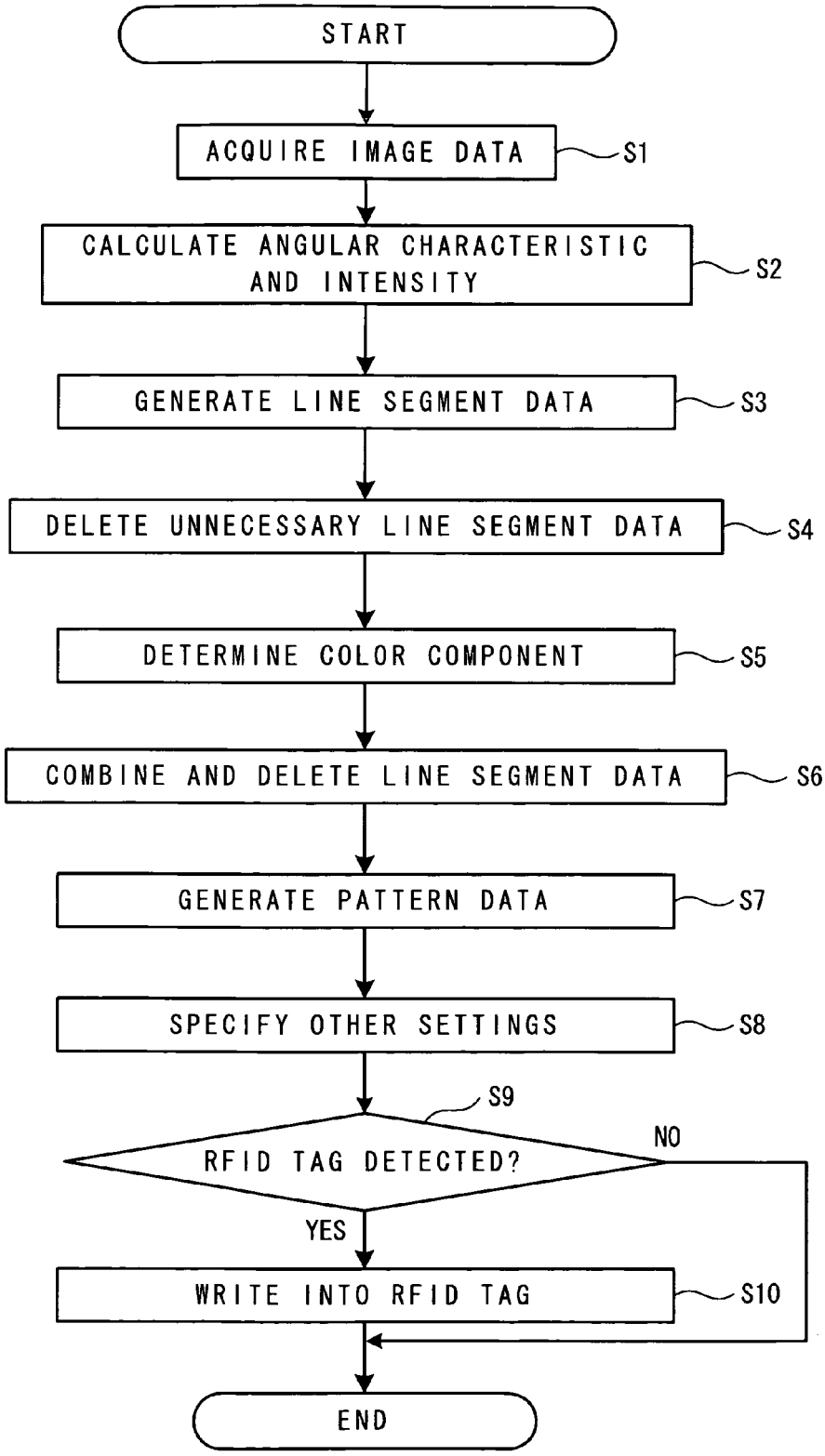
FIG. 9 is a flowchart of embroidery data generation processing.

Processing from input of image data in step 1 (S1) to generation of pattern data in step 7 (S7) shown in FIG. 9 may be performed by any known method for generating data of an embroidery pattern from image data, such as data of an arbitrary design or picture read by the image scanner 116. For example, a method disclosed in Japanese Patent Application Laid Open Publication No. 2001-259268 may be employed. Therefore, the processing is only outlined below, omitting detailed explanation. When the embroidery data generation program is activated to start the processing, the CPU 101 first acquires data of an image inputted from the image scanner 116 and stores the image data into the RAM 103 (S1). Next, the CPU 101 performs gray-scaling and Laplace transform on the input image data, and calculates an angular characteristic and its intensity for each of the pixels that form the image in step 2 (S2). Based on the calculated angular characteristic and intensity for each pixel, the CPU 101 generates line segment data that defines a line segment along which a stitch is finally to be formed in step 3 (S3). The final line segment data to be generated contains an angle component, a length component, and a color component. The line segment data generated at this stage (S3), however, does not contain the color component. Then, the CPU 101 deletes line segment data pieces that will be inappropriate or unnecessary for generation of the pattern data, which will be performed later, from the generated line segment data in step 4 (S4). For each piece of the remaining line segment data containing the angle component and the length component, the CPU 101 determines a color component with reference to surrounding colors in step 5 (S5). After the line segment data containing the color component is generated, the CPU 101 combines and deletes the line segment data pieces considering an overlap between the line segments in step 6 (S6). After the final line segment data containing the angle, the length, and the color components is generated in such a manner, the CPU 101 converts the line segment data. Specifically, a starting point and an ending point of each line segment are converted into a starting point and an ending point of each stitch, for each of the color components. By determining the sewing sequence for the starting points and the ending points of the stitches, the CPU 101 generates pattern data and stores the pattern data into a predetermined storage area of the RAM 103 in step 7 (S7).

The generated pattern data contains sewing information that provides a command for the CPU 45 and the corresponding data as shown in, for example, FIG. 10. The pattern data can be used by the CPU 45 of the sewing machine 11 to read the commands sequentially from the top in the table in FIG. 10 to perform sewing processing in step 17 (S17) (in FIG. 13). For example, in FIG. 10, the CPU 45 first follows the first row command of "color changeover A, pink" to thereby select a needle bar 27 having a sewing needle supplied with a pink-colored thread from among the six needle bars 27 in the sewing machine 11. Next, the CPU 45 follows the second row command of "sewing data, Xa0, Ya0" to thereby control the component parts of the sewing machine 11 so that the embroidery frame is moved in such a manner that the sewing needle 19 may fall at the position of "Xa0, Ya0" as a sewing starting position. The sewing processing (S17 in FIG. 13) is described in detail later. It is to be noted that the color data for "pink" in the table is actually given as, for example, data of RGB-values.

Following the generation of the pattern data (S7), other settings can be specified as necessary, based on information inputted by the operator via the mouse 111 or the keyboard 112 in step 8 (S8). Specifically, for example, the pattern data generated at S7 can be edited or the tension or the sewing speed can be set. The pattern data can be edited in accordance with an instruction inputted by the operator via the mouse 111 or the keyboard 112 as the operator looks at the pattern shown on the display device 115. The CPU 101 generates edit data that reflects the input by the operator, and stores the edit data into a predetermined storage area of the RAM 103. As shown in FIG. 11, the edit data contains edit information and the corresponding data. The edit data indicates how the original pattern data has been edited. For example, the edit data includes "horizontal mirror," "vertical mirror," "movement X," "movement Y." "rotation," "scale up/down X," "scale up/down Y," "spacing," "array," "color change," and "density." To "horizontal mirror" corresponds data that indicates whether a pattern is horizontally flipped or not by 1 or 0. To "vertical mirror" corresponds data that indicates whether a pattern is vertically flipped or not by 1 or 0. To "movement X" and "movement Y" correspond data pieces that respectively indicate an X-directional (right-and-left directional) and a Y-directional (front-and-rear directional) movement distances in figures (mm). To "rotation" corresponds data that indicates a rotation angle of a pattern in figures (°). To "scale up/down X" and "scale up/down Y" correspond data pieces that respectively indicate X-axial and Y-axial scale up/down ratio of a pattern in figures (%). To "spacing" corresponds data that indicates spacing between character patterns in figures (mm). To "array" corresponds data that indicates an arrangement of the character patterns (e.g., standard array, curve array 1, curve array 2, slant array 1, or slant array 2) by a data number. To "color change" corresponds data that indicates a change in color of a pattern by the RGB-values of a thread color. To "density" corresponds data that indicates a thread density in a pattern in figures (%). For example, the edit data of FIG. 11 indicates that the operator has inputted instructions to flip a pattern horizontally, move it by 20 mm in the X-direction and 40 mm in the Y-direction, and change the color of a thread to be used second in sewing. The respective data for the other items that have not been edited shows the initial value of "0".

Further, the tension of the upper thread and the sewing speed may be respectively set so that fine stitches can be formed in sewing the embroidery pattern on the garment 8 based on the generated pattern data. The tension and the sewing speed may be set corresponding to a material and a cloth thickness of the garment 8 and the types of the upper and the lower threads to be used. For each combination of a work cloth and types of upper and lower threads, which are respectively selected from among a plurality of general types of work clothes, upper and lower threads, average values for the tension of the upper thread and the sewing speed can be determined to enable forming of fine stitches. In the embroidery data processing apparatus 10, which is a dedicated machine, the average values for the tension of the upper thread and the sewing speed are set as default values when the embroidery data processing apparatus 10 is shipped from the factory. The operator may change the default values if the operator determines that the default values need to be changed, considering the material and the cloth thickness of the garment 8 on which a pattern is to be actually sewn, and the types of the upper and the lower threads to be used (for example, thickness and material, thread colors, and manufacturer of the threads). On the other hand, if the operator determines that it is unnecessary to change the default values, they may be left as they are The tension value for the upper thread and the sewing speed are respectively stored as tension data and sewing speed data into predetermined storage areas of the RAM 103 (S8).

After other settings are specified (S8), at step 9 (S9) the CPU 101 determines whether the RFID tag 800 is detected by the RFID reader/writer 117 (YES at S9). The RFID reader/writer 117 has a predetermined communication range. When the garment 8 (see FIG. 3), to which the label 80 with the RFID tag 800 is attached, is positioned in the communication range, the RFID reader/writer 117 detects the RFID tag 800 (YES at S9). In such a case, the CPU 101 respectively writes the pattern data (see FIG. 10), edit data (see FIG. 11), the tension data, and the sewing speed data into the pattern information storage area 8261, the edit information storage area 8263, the tension information storage area 8264, and the sewing speed storage area 8265 in the memory section 826 (see FIG. 5) of the RFID tag 800 by the RFID reader/writer 117 in step 10 (S10). Then the embroidery data generation processing shown in FIG. 9 ends. On the other hand, if the RFID tag 800 is not detected (NO at S9), the CPU 101 ends the processing immediately.

Figure 13:
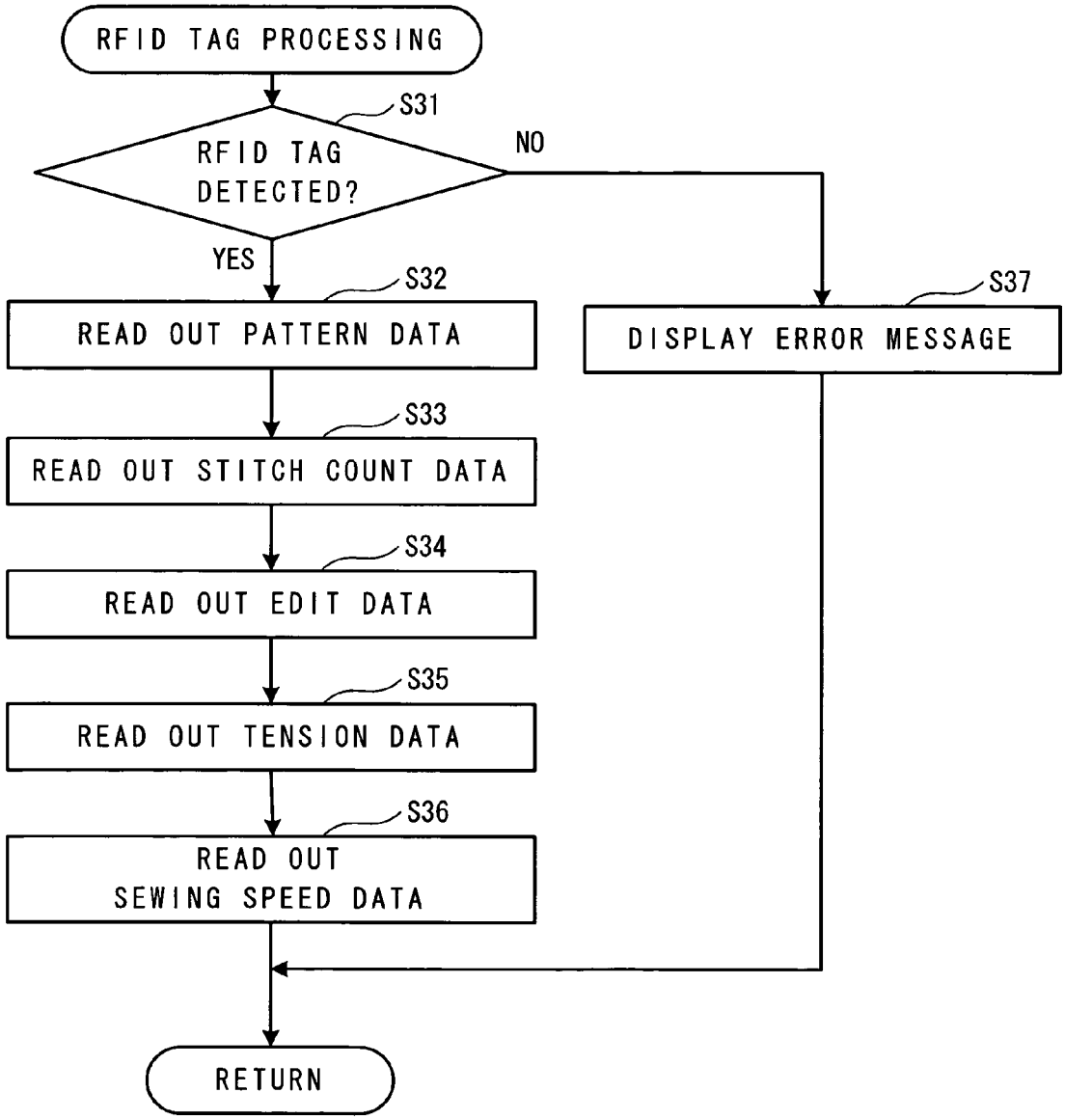
FIG. 13 is a flowchart of RFID tag processing performed in the main processing of FIG. 12.
Figure 14:
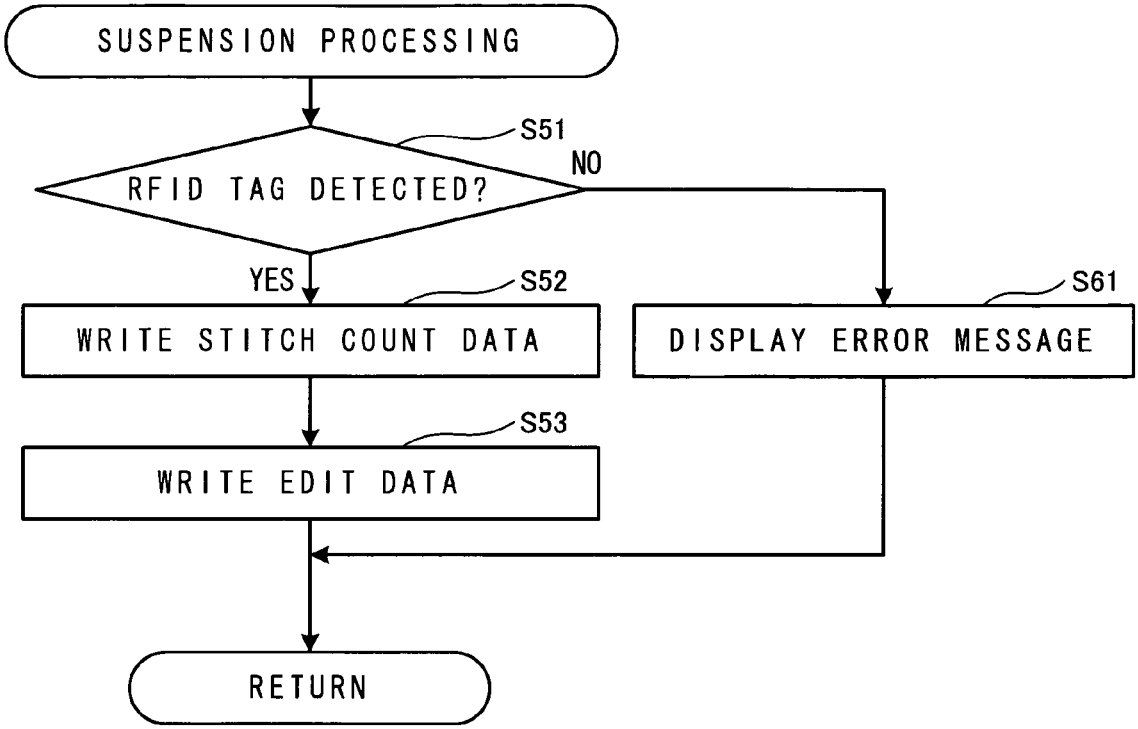
FIG. 14 is a flowchart of suspension processing performed in the main processing of FIG. 12.

Next, a processing to be performed when an embroidery pattern is sewn by the sewing machine 11 in accordance with the data generated as described above and stored in the RFID tag 800 attached to the garment 8. The sewing control program that causes the CPU 45 (see FIG. 7) to perform the processing shown in FIGS. 12-14 is stored beforehand in the ROM 46.

Figure 12:
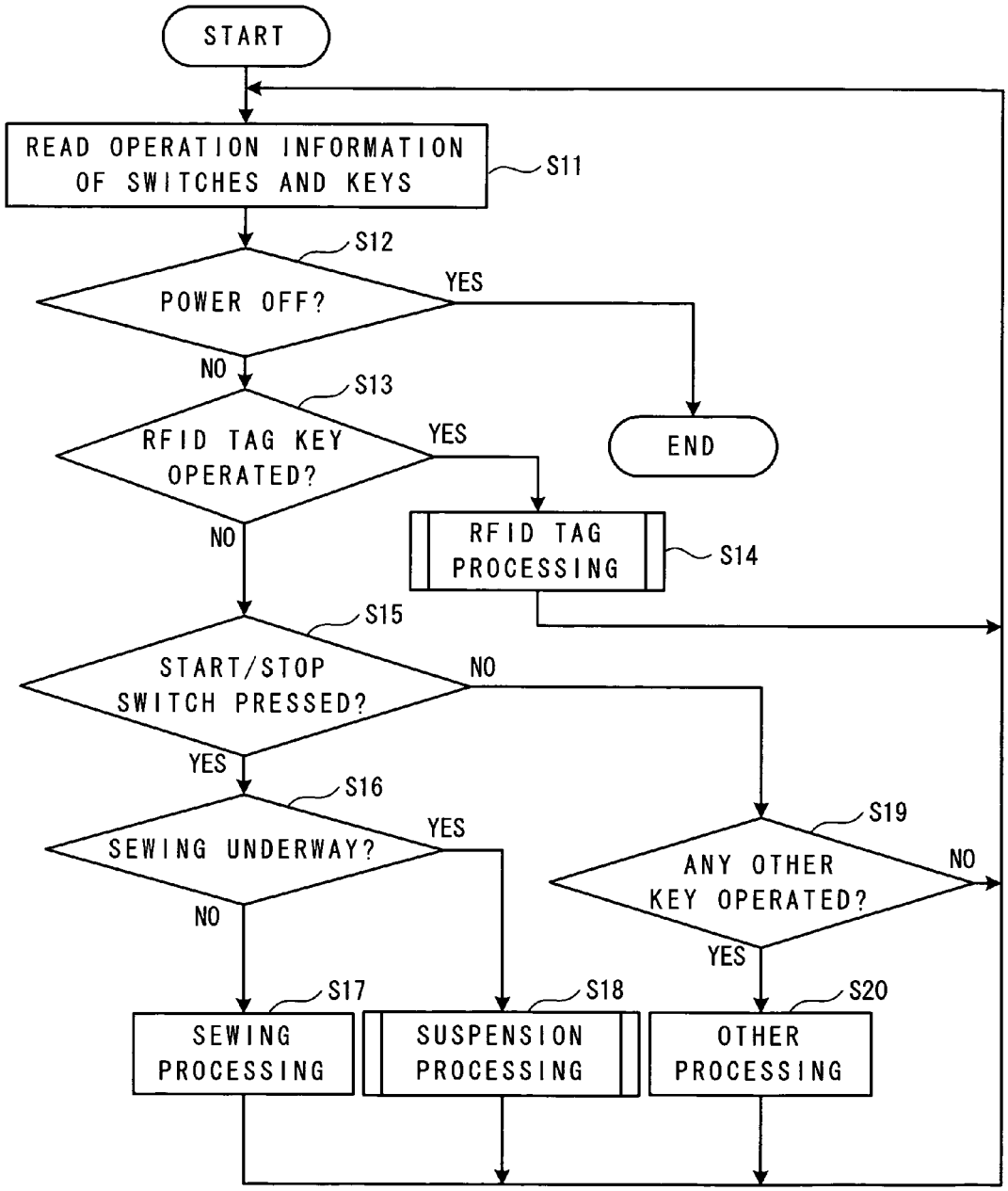
FIG. 12 is a flowchart of main processing for controlling the sewing machine.

Main processing shown in FIG. 12 starts when the power switch (not shown) of the sewing machine 11 is turned ON. Following the start of the processing, the CPU 45 performs initialization processing on the sewing machine 11, reads operation information of various switches and keys provided on the sewing machine 11, and stores the information in a predetermined storage area of the RAM 47 in step 11 (S11). Then, in step 12 (S12) if the power switch has not been turned OFF (NO at S12), the CPU 45 determines whether an RFID tag key 36 is operated, based on the information read at S11 in step 13 (S13). The LCD 30 of the sewing machine 11 displays an opening screen and then a pattern selection screen shown in FIG. 16. On the pattern selection screen, a plurality of operation keys is displayed. The operation keys include various pattern keys 37 and specification keys for specifying a medium to be accessed to read the pattern data. If it is determined that the RFID tag key 36 is selected with a finger or a dedicated pen from among the operation keys (YES at S13), RFID tag processing is performed in order to conduct sewing control based on the information stored in the RFID tag 800 in step 14 (S14).

Now, the RFID tag processing performed at S14 of FIG. 12 is described below in detail with reference to FIG. 13. Following the start of the RFID tag processing, first the CPU 45 determines whether the RFID tag 800 is detected by the RFID reader/writer 35 (see FIG. 7) in step 31 (S31). The RFID reader/writer 35 has a predetermined communication range. When the garment 8 (see FIG. 3), to which the label 80 with the RFID tag 800 is attached, is positioned in the communication range, the RFID tag 800 is detected (YES at S31). In such a case, the CPU 45 reads out the pattern data stored in the pattern information storage area 8261 (see FIG. 5) of the RFID tag 800 via the RFID reader/writer 35 and stores the pattern data into the pattern information storage area 471 (see FIG. 8) of the RAM 47 in step 32 (S32). The pattern data that is read out here has been generated and written into the RFID tag 800 by the embroidery data processing apparatus 10 as described above (see FIGS. 9 and 10). Next, the CPU 45 reads out the stitch count data stored in the stitch count information storage area 8262 of the RFID tag 800 and stores it into the stitch count information storage area 472 of the RAM 47 in step 33 (S33). As shown in FIG. 15, the stitch count data contains numeric data that indicates the number of stitches already formed in accordance with the pattern data. Prior to sewing, "0" is stored in the RFID tag 800 as an initial value of the stitch count data. Accordingly, if the RFID tag processing is performed immediately after sewing starts, "0" is acquired as the stitch count data and stored into the stitch count information storage area 472 of the RAM 47. If a suspension processing has been performed in step 18 (S18) (see FIG. 12) during sewing, the number of stitches which were formed up to that time is stored, which is described later.

After the stitch count data is read out (S33), the edit data stored in the edit information storage area 8263 of the RFID tag 800 is read out and stored into the edit information storage area 473 of the RAM 47 in step 34 (S34). Subsequently, the tension data stored in the tension information storage area 8264 (see FIG. 5) of the RFID tag 800 is read out and stored into the tension information storage area 474 (see FIG. 8) of the RAM 47 in step 35 (S35). Furthermore, the sewing speed data stored in the sewing speed information storage area 8265 (see FIG. 5) of the RFID tag 800 is read out and stored into the sewing speed information storage area 475 (see FIG. 8) of the RAM 47 (S35). With this, as the reading of the data pieces stored in the RFID tag 800 is all completed, the CPU 45 ends the RFID tag processing and returns to the main processing shown in FIG. 12.

Figure 17:
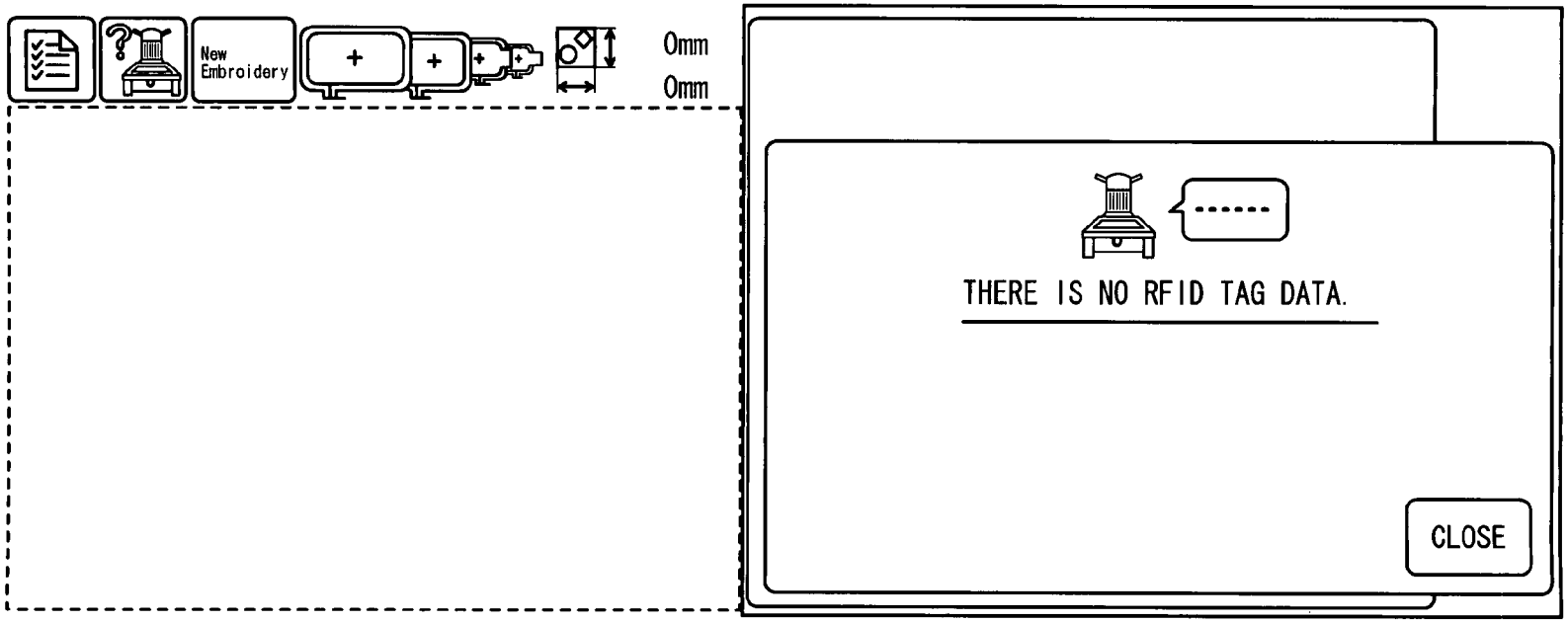
FIG. 17 is a schematic illustration of an error display screen.

On the other hand, if the RFID tag 800 is not detected at S31 of the RFID tag processing (NO at S31), the CPU 45 displays an error message on the LCD 30 in step 37 (S37). In such a case, as shown in FIG. 17, for example, a message of "There is no RFID tag data" is displayed on the LCD 30. Then, the CPU 45 ends the RFID tag processing and returns to the main processing shown in FIG. 12. After returning to the main processing, in both cases, the CPU 45 returns to the reading the operation information of the switches and the keys (S11).

If neither the power switch nor the RFID tag key 36 is operated (NO at S12 and NO at S13) after the main processing is started, the CPU 45 determines whether the start/stop switch 33 to instruct the starting or the stopping of sewing is pressed down in step 15 (S15). If it is determined that the start/stop switch 33 is pressed down (YES at S15), the subsequent processing depends on whether sewing is currently underway. Accordingly, the CPU 45 determines whether sewing is going on in step 16 (S16). If sewing is not underway (NO at S16), the CPU 45 determines that the starting of sewing is instructed and performs the sewing processing (S17). The sewing processing is performed based on the pattern data, the stitch count data, the edit data, the tension data, and the sewing speed data, which are respectively stored in the pattern information storage area 471, the stitch count information storage area 472, the edit information storage area 473, the tension information storage area 474, and the sewing speed information storage area 475.

For example, in the case of performing sewing based on the pattern data shown in FIG. 10, the CPU 45 first follows the first row command of "color changeover A, pink" to thereby select one of the six needle bars 27 of the sewing machine 11 that has a sewing needle supplied with a pink colored thread. For the second row command of "sewing data, Xa0, Ya0", if the edit data indicates that a pattern is to be horizontally flipped and moved by 20 mm in the X-direction and 40 mm in the Y-direction as shown in FIG. 11, first the data of "Xa0, Ya0" of the sewing starting point is modified in accordance with the instruction. The CPU 45 drops the sewing needle to the point of the modified coordinates by controlling the sewing machine drive section 57, and the embroidery frame drive section 65, etc. (see FIG. 7). Similarly, the CPU 45 continues the sewing processing in accordance with the pattern data and the edit data of the third row, the fourth row, etc., in this order. When the row of "color change B" is read, the edit data indicates that the thread color should be changed. Accordingly, the CPU 45 selects the needle bar 27 that has a sewing needle supplied with a thread of a color (e.g., "red") that corresponds to the instruction of the edit data, instead of a thread of "deep pink" specified by the original pattern data. When a stitch corresponding to the last row data of (XdN, YdN) is formed in such a manner, an embroidery pattern is completed to end the sewing. Further, the thread tension and the sewing speed during sewing are controlled by the CPU 45 to match the respective values stored in the tension information storage area 474 and the sewing speed information storage area 475 of the RAM 47. It is to be noted that the sewing machine 11 in this embodiment is not equipped with an automatic tension adjustment mechanism that automatically adjusts the tension of the upper thread 23. Therefore, the tension of the upper thread 23 needs to be adjusted by the operator manually operating the thread tensioner 24 (see FIG. 6) disposed on the upper surface of the arm 14. In such a case, the tension data is ignored and only the sewing speed is controlled. When the sewing processing is completed, the CPU 45 returns to the reading step of the operation information of the switches and the keys again (S11).

If the start/stop switch is pressed down during sewing (YES at S15 and YES at S16), it means that stopping of sewing is instructed. Accordingly, the suspension processing is performed to enable resuming of sewing later from the point when sewing has been suspended (S18). Now, the suspension processing is described below in detail with reference to FIG. 14. Following the start of the suspension processing, first the CPU 45 determines whether the RFID tag 800 is detected by the RFID reader/writer 35 (see FIG. 7) (S51). If the RFID tag 800 is not detected (NO at S51), the CPU 45 causes the LCD 30 to display an error message of, for example, "There is no RFID tag data" as shown in FIG. 17 (S61). Then, the CPU 45 ends the suspension processing and returns to the main processing shown in FIG. 12 to read the operation information of the switches and the keys (S11).

On the other hand, if the RFID tag 800 is detected in the suspension processing (YES at S51), the CPU 45 stores the stitch count data at the time of suspension, which is stored in the stitch count information storage area 472 (see FIG. 8) of the RAM 47, into the stitch count information storage area 8262 of the memory section 826 (see FIG. 5) of the RFID tag 800 (S52). It is to be noted that the number of stitches that have been formed in accordance with the pattern data (see FIG. 10) after the start of sewing is stored as the stitch count data in the stitch count information storage area 472 of the RAM 47. Specifically, as sewing proceeds, the stored numeral increases gradually. When all the pattern data is read to complete sewing, the stitch count data is reset to "0". Since the suspension processing is performed during sewing, when the stitch count data is written into the RFID tag 800 at S52, a numeral other than "0", for example, "638" is stored as the stitch count data.

Subsequently, the CPU 45 writes the edit data stored in the edit information storage area 473 (see FIG. 8) of the RAM 47 into the edit information storage area 8263 of the memory section 826 (see FIG. 5) of the RFID tag 800 in step 53 (S53). For example, if the pattern has been edited separately in step 20 (S20), the step of other processing (see FIG. 12), which is described later, the edit data set and stored in the other processing (S20) is written into the RFID tag 800 (S53). After having written the stitch count data at the time of suspension and the edit data into the RFID tag 800, the CPU 45 returns to the main processing of FIG. 12 to read the operation information of the switches and the keys again (S11).

If what has been acquired as the operation information (S11) following the start of the main processing shown in FIG. 12 is none of the power switch, the RFID tag key 36, and the start/stop switch 33 (NO at S12, NO at S13, and NO at S14) but in step 19 (S19) any other key (YES at S19), other processing indicated by the operated switch or key is carried out (S20). For example, in the sewing machine 11, the operator can select an embroidery pattern stored in the ROM 46 of the sewing machine 11 on the pattern selection screen (see FIG. 16) displayed on the LCD 30 via any one of the various pattern keys 37 to sew the embroidery pattern. If an embroidery pattern is selected, the pattern data of the selected embroidery pattern is acquired from the ROM 46 and stored into the pattern information storage area 471 of the RAM 47. Further, the operator can display a pattern on an edit screen (not shown) on the LCD 30 to edit it, using various edit keys. The pattern to be edited may be the embroidery pattern selected on the pattern selection screen or the embroidery pattern based on the pattern data (which is generated by the embroidery data processing apparatus 10) read out from the RFID tag 800 in the RFID tag processing (S14). The pattern may be edited by operating, for example, a horizontal mirror key, a vertical mirror key, a movement keys, a rotation key, a size key, a spacing key, an array key, a color change key, and a density key. The horizontal mirror key is used to instruct a horizontal flip of a pattern. The vertical mirror key is used to instruct a vertical flip of a pattern. The movement key is used to specify a movement direction and a movement distance of a pattern. The rotation key is used to specify a rotation angle of a pattern. The size key is used to specify a scale up/down ratio of a pattern. The spacing key is used to specify spacing between character patterns. The array key is used to specify an arrangement of character patterns. The color change key is used to instruct a color change of a pattern. The density key is used to specify a thread density of the pattern. Data input from the edit keys is stored in the edit information storage area 473 of the RAM 47 as the edit data (see FIG. 11). If no keys are operated (NO at S19), the CPU 45 directly returns to the reading step of the operation information of the switches and the keys again (S11).

If it is determined that the power switch (not shown) is turned OFF immediately after the start of the processing or in any cycle of the processing (YES at S12), the CPU 45 ends the main processing of FIG. 12.

Next, an example of how the processing is performed is described below with reference to FIGS. 12-14. In the example, it is supposed that information is first read out from the RFID tag 800 in the RFID tag processing (S14), a pattern is edited and the sewing speed is changed in the other processing (S20), the information at the time of suspension is written into the RFID tag 800 in the suspension processing (S18) during the course of sewing based on the edited data, and sewing is resumed after other interruption processing.

First, the operator turns ON the sewing machine 11 and attaches to the sewing machine 11 the embroidery frame (not shown) holding the garment 8 on which an embroidery pattern is to be sewn. Then, if the operator selects the RFID tag key 36 on the pattern selection screen displayed on the LCD 30 (S11, NO at S12, and YES at S13 in FIG. 12), the RFID tag processing (S14 in FIG. 12 and S31-S36 in FIG. 13) is carried out as described above. In the RFID tag processing, pattern data, stitch count data, edit data, tension data, and sewing speed data are read out from the memory section 826 of the RFID tag 800 and respectively stored into the storage areas 471-475 of the RAM 47. In this example, among the read and stored data pieces, the pattern data, the edit data, the tension data, and the sewing speed data have been generated or set in the embroidery data processing apparatus 10, and written into the RFID tag 800 beforehand. On the other hand, the read out and stored stitch count data is initial value "0". The operator may subsequently input an instruction to, for example, scale down the pattern by 70% both vertically and horizontally from the size key on the edit screen (S11, NO at S12, NO at S13, NO at S15, YES at S19 in FIG. 12). In this case, in accordance with the inputted instruction, the CPU 45 changes both data pieces corresponding to the edit information "scale up/down X" and "scale up/down Y" to "70(%)," among the edit data of FIG. 11 stored in the edit information storage area 473 of the RAM 47 (S20 in FIG. 12). Then, if sewing is started with the start/stop switch 33 (S1, NO at S12, NO at S13, YES at S15, NO at S16 in FIG. 12), the CPU 45 sequentially reads the pattern data pieces and scales down the pattern by 70% in accordance with the changed edit data to perform sewing (S17). If the start/stop switch 33 is pressed down again before sewing ends (S11, NO at S12, NO at S13, YES at S15, YES at S16 in FIG. 12), the suspension processing is performed (S8 in FIG. 12). In the suspension processing, the number of stitches formed so far, for example, "638" is stored as the stitch count data into the stitch count information storage area 8262 of the RFID tag 800 (S52 in FIG. 14). Furthermore, the edit data changed in the other processing (S20 in FIG. 12) as described above is stored into the edit information storage area 8263 (S53 in FIG. 14).

Subsequently, suppose, for example, that the operator selects another pattern data on the pattern selection screen and a corresponding embroidery pattern is sewn in an interruption processing (S11, NO at S12, NO at S13, NO at S15, YES at S19, S20, S11, NO at S12, NO at S13, YES at S15, NO at S16, S17 in FIG. 12). Then, when the interruption processing is completed, the pattern data and the edit data that have been set during the interruption processing are stored in the RAM 47. If the operator sets to the sewing machine 11 again, the embroidery frame holding the garment 8 with an unfinished embroidery pattern, and instructs performance of the RFID tag processing via the RFID tag key 36 (S11, NO at S12, YES at S13 in FIG. 12), then, the pattern data, the stitch count data, and the edit data that have been stored in the suspension processing (S18 in FIG. 12) are read out from the memory section 826 of the RFID tag 800 (S14 in FIG. 12 and S31-S36 in FIG. 13). Specifically, as the pattern data, the data that has been generated beforehand in the embroidery data processing apparatus 10 and that has been stored from the beginning is read out. As the stitch count data, "638" is read out. Further, as the edit data, the data in which the data pieces corresponding to the edit information pieces of "scale up/down X" and "scale up/down Y" are changed to "70(%)", is read out.

In the case of subsequently performing the sewing processing based on the data read out in the RFID tag processing (S14 in FIG. 12) (S11, NO at S12, NO at S13, YES at S15, NO at S16, S7 in FIG. 12), the CPU 45 first references the stitch count data "638" stored in the stitch count information storage area 472 of the RAM 47. Then, the pattern data pieces are sequentially read, starting from the data piece that corresponds to the 639'th stitch among the pattern data stored in the pattern information storage area 471, the original pattern is scaled down by 70% in accordance with the edit data stored in the edit information storage area 473, thereby performing sewing. Even in a case where the sewing speed data is originally set to a default value of 700 rpm, if the operator has manually set the maximum sewing speed of the drive shaft of the sewing machine 11 to 600 rpm, the speed set by the operator, that is, 600 rpm is prioritized in sewing. The maximum sewing speed can be manually set with a maximum sewing speed setting key displayed on a sewing setting screen (not shown) on the LCD 30.

As described above, in the embroidery sewing system 1 according to the present embodiment, the embroidery data processing apparatus 10 can generate pattern data of an embroidery pattern from image data of a desired design or picture, and edit data, tension data, and sewing speed data that specify sewing conditions can be appropriately set. Then, those data pieces can be stored into the RFID tag 800 attached to a garment 8. Subsequently, the sewing machine 11 can sew an embroidery pattern based on the pattern data, the edit data, the tension data, and the sewing speed data stored in the RFID tag 800. Therefore, for example, the troublesome and time-consuming job of generating the pattern data and the setting of the tension and the sewing speed, which requires knowledge of material, can be entrusted to an expert who operates the embroidery data processing apparatus 10. To sew a desired embroidery pattern, the operator of the sewing machine 11 only needs to bring back the garment 8, set it to the operator's own sewing machine 11, and press the start/stop switch 33. Further, for example, even if the same person performs both generation of the embroidery data by use of the embroidery data processing apparatus 10 and sewing of the embroidery pattern by use of the sewing machine 11, it is possible to perform batch processing, for example, when various kinds of embroidery patterns are sewn on many garments 8. In such a case, the efficiency of sewing can be improved. The batch processing herein refers to processing in which the pattern data and other data for embroidery patterns is first generated, then the generated data is written into the RFID tag 800 attached to each of the respective garments 8 subject to embroidering, and then respective embroidery patterns are sewn on the respective garments 8 later at a convenient time. Furthermore, the generated pattern data etc. can accompany the garment 8 subject to embroidering by the label 80 having the RFID tag 800. Therefore, when generation of the data and embroidery sewing are carried out at separate times or separate positions, it is possible to avoid a problem that the pattern data etc. and the garment 8 are later found to be mismatched. Accordingly, it is possible to reduce the job of cross-checking.

Further, in the embroidery sewing system 1 according to the present embodiment, when embroidery sewing by use of the sewing machine 11 is suspended, the data of the number of stitches that have been formed up to the time of suspension can be written into the RFID tag 800. Therefore, to resume embroidery sewing, the stitch count data can be read out from the RFID tag 800 to continue embroidery sewing in the same state as that of the time of suspension. With the conventional sewing machines, if sewing of an embroidery pattern is suspended and a different embroidery pattern is sewn, it is impossible to resume sewing of the previous unfinished embroidery pattern. On the other hand, by the embroidery sewing system 1, even if sewing an embroidery pattern is suspended and a different embroidery pattern is sewn, it is possible to resume sewing in the same state as that at the time of suspension. In other words, an interruption processing is enabled, thereby improving the efficiency in sewing. For example, it is supposed that an embroidery pattern is sewn by an ordinary sewing machine having a single needle bar onto each of three work cloths using three thread colors. In this case, it is necessary to replace the upper thread (thread spool) nine (=3×3) times. However, by employing the processing of the present embodiment, it is possible to sequentially sew the three work cloths with the same thread color without replacing the thread spool, and then replace the thread spool with another thread spool of another thread color to perform subsequent sewing. This procedure can be repeated to complete sewing with three thread spools having three different colors. In other words, it is possible to complete the sewing processing with a suspension after sewing with each thread color. Therefore, the upper thread needs to be replaced only three times. In contrast, the number of times of replacing the embroidery frame, to which the work cloth is attached, increases. Replacement of the embroidery frame is easier than replacement of the upper thread, which involves hooking of the upper thread along a guide path and threading a sewing needle. Therefore, efficiency in sewing as a whole can be improved. Further, even when sewing is suspended out of necessity owing to an occurrence of a trouble in the course of sewing, sewing can be resumed in the same state as that of the time of suspension.

The embroidery sewing system of the present disclosure is not limited to the aforementioned embodiment and can be modified variously. For example, in the sewing machine 11 in the embroidery sewing system 1 according to the above-described embodiment, the tension of the upper thread 23 supplied from the thread spool 22 needs to be adjusted by the operator manually operating the tensioner 24 (see FIG. 6) disposed on the upper surface of the arm 14. Therefore, in the embroidery data generation processing shown in FIG. 9, even if the tension data is generated and stored in the tension information storage area 8264 of the RFID tag 800 beforehand, the tension data is not utilized in the sewing machine 11. Therefore, the sewing machine 11 may be replaced by a sewing machine having an automatic tension adjusting mechanism that automatically adjusts the tension of the upper thread 23 in accordance with a pattern. In such a case, based on the tension data, the tension value of the upper thread 23 can be controlled by the automatic tension adjusting mechanism. It is thus possible for a sewing machine operator not familiar with sewing to sew an embroidery pattern, using an optimal tension value that has been set by an expert who operates the embroidery data processing apparatus 10.

In the aforementioned embodiment, the embroidery data processing apparatus 10 is configured so that image data of a desired design or picture is mainly taken in with the image scanner 116 to generate pattern data. However, the embodiment of the embroidery data processing apparatus is not limited to that but only needs to be able to generate embroidery data including pattern data and write the generated data into the RFID tag. For example, as the embroidery data processing apparatus, the sewing machine 11 of the above-described embodiment may be employed. In this case, the operator can generate the pattern data etc. by operating the various keys on the edit and setting screens displayed on the LCD 30 and write the data into the RFID tag 800 using the RFID reader/writer 35.

Although the above-described embodiment employs a multi-needle type sewing machine having six needle bars, the sewing machine 11 may be replaced with a sewing machine having a single needle bar or a multi-needle type sewing machine having more or less needle bars.

Further, the above embodiment has been described with reference to an example where the RFID tag 800 is sewn into the label 80 for product marking attached to the neck portion of the garment 8. However, the work cloth subject to embroidery sewing is not limited to a garment. Further, the position to which the RFID tag 800 is attached is not limited to that of this example. For example, the work cloth may be original fabric or any other cloth product such as a handkerchief, a scarf, a towel, or a necktie. Further, as for the attachment position of the RFID tag 800, in the case of a garment, for example, the label 80 having an RFID tag similar to that of the embodiment can be sewn onto the inside of a pocket or onto a lining where the front and the back bodies are sewn up. Further, the RFID tag 800 may be embedded in a button or a fastener or a thread-like RFID tag may be interwoven into the fabric. Alternatively, the RFID tag 800 may be attached to a brand emblem, a price tag, a price seal, etc. attached to the garment 8.

What is claimed is:

1. An embroidery sewing system comprising:

an embroidery data processing apparatus that generates and processes embroidery data to sew an embroidery pattern on a work cloth as a sewing target; and a sewing apparatus, wherein the embroidery data processing apparatus comprises:

an embroidery data generation device that generates embroidery data including pattern data for specifying a color and a shape of the embroidery pattern; and a data writing device that writes the embroidery data generated by the embroidery data generation device into a Radio Frequency Identification (RFID) tag attached to the work cloth, and wherein the sewing apparatus comprises:

a sewing device that sews the embroidery pattern based on the embroidery data generated and processed by the embroidery data processing apparatus;

a data reading device that reads out the embroidery data written into the RFID tag by the data writing device; and a control device that controls the sewing device based on the embroidery data read out from the RFID tag by the data reading device.

2. The embroidery sewing system according to claim 1, wherein:

the sewing apparatus further comprises a progress writing device that writes into the RFID tag data relating to a progress in sewing the embroidery pattern at the time of suspension, if sewing the embroidery pattern by the sewing device is suspended;

the data reading device reads out the progress data written into the RFID tag by the progress writing device; and the control device controls the sewing device based on the progress data read out from the RFID tag by the data reading device.

3. The embroidery sewing system according to claim 2, wherein the progress data includes stitch count data that identifies a number of stitches, the number of stitches being a number of times a sewing needle has sewn the work cloth.

4. The embroidery sewing system according to claim 1, wherein the pattern data includes needle drop point data, sewing sequence data, and thread color data, the needle drop point data specifying a position where a sewing needle drops, the sewing sequence data specifying a sewing order for the needle drop points, and the thread color data specifying a color of a sewing thread.

5. The embroidery sewing system according to claim 1, wherein the embroidery data includes edit data relating to at least one of:

whether the embroidery pattern is flipped;

a movement distance of a sewing position of the embroidery pattern;

a rotation angle of the embroidery pattern;

a scale up/down ratio of the embroidery pattern;

a distance between a plurality of partial patterns included in the embroidery pattern;

an arrangement of the partial patterns;

a change in color of the sewing thread; and a thread density in the embroidery pattern.

6. The embroidery sewing system according to claim 1, wherein the embroidery data includes tension data that specifies a tension of an upper thread suitable for the work cloth.

7. The embroidery sewing system according to claim 1, wherein the embroidery data includes sewing speed data that specifies a sewing speed suitable for the work cloth.

* * * * *